US008164409B2

(12) United States Patent
Kudo et al.

(10) Patent No.: US 8,164,409 B2
(45) Date of Patent: Apr. 24, 2012

(54) COIL COMPONENT

(75) Inventors: Takashi Kudo, Tokyo (JP); Masatoshi Shindoh, Shindoh (JP); Yuu Okabe, Tokyo (JP); Hiroki Kobayashi, Tokyo (JP); Takashi Kudo, Tokyo (JP)

(73) Assignee: TDK Corporation, Tokyo (JP)

( * ) Notice: Subject to any disclaimer, the term of this patent is extended or adjusted under 35 U.S.C. 154(b) by 66 days.

(21) Appl. No.: 12/801,176

(22) Filed: May 26, 2010

(65) Prior Publication Data

US 2011/0001595 A1 Jan. 6, 2011

(30) Foreign Application Priority Data

Jul. 2, 2009 (JP) ..... 2009-157852
Aug. 12, 2009 (JP) ..... 2009-187108

(51) Int. Cl.
*H01F 27/02* (2006.01)
*H01F 27/24* (2006.01)

(52) U.S. Cl. ..... 336/212; 336/208; 336/83

(58) Field of Classification Search ..... 336/212, 336/208, 198, 192

See application file for complete search history.

(56) References Cited

U.S. PATENT DOCUMENTS

| | | | |
|---|---|---|---|
| 5,010,313 | A | 4/1991 | Kaneko et al. |
| 5,530,416 | A | 6/1996 | Wakamatsu et al. |
| 6,649,524 | B2 | 11/2003 | Watanabe |
| 6,747,538 | B2 | 6/2004 | Kuwata et al. |
| 2008/0252406 | A1 | 10/2008 | Kitajima et al. |

FOREIGN PATENT DOCUMENTS

| | | |
|---|---|---|
| JP | A-62-009608 | 1/1987 |
| JP | A-03-006804 | 1/1991 |
| JP | A-03-242907 | 10/1991 |
| JP | A-05-047563 | 2/1993 |
| JP | A-5-347207 | 12/1993 |
| JP | U-07-018417 | 3/1995 |
| JP | A-09-092542 | 4/1997 |
| JP | A-10-022138 | 1/1998 |
| JP | B2-3116696 | 10/2000 |
| JP | A-2001-237135 | 8/2001 |
| JP | A-2001-338818 | 12/2001 |

(Continued)

OTHER PUBLICATIONS

Japanese Office Action issued in Application No. 2009-187108; Dated May 19, 2011 (With Translation).

(Continued)

*Primary Examiner* — Anh Mai
(74) *Attorney, Agent, or Firm* — Oliff & Berridge, PLC

(57) ABSTRACT

A coil component ensuring adhesive bonding between first and second cores. The coil component also includes an inductive component and a pair of terminal electrodes. The first core has a first adhesion surface. The second core is connected to the first core by an adhesive agent and has a second adhesion surface in confrontation with the first adhesion surface. At least one of the first adhesion surface and the second adhesion surface is formed of a glass surface layer to which the adhesive agent is applied. The inductive component is wound over the first core. The pair of terminal electrodes are provided at one of the first core and the second core. The inductive component has one end portion electrically connected to one of the terminal electrodes and has another end portion electrically connected to remaining one of the terminal electrodes.

13 Claims, 7 Drawing Sheets

FOREIGN PATENT DOCUMENTS

| | | |
|---|---|---|
| JP | A-2003-109823 | 4/2003 |
| JP | A-2004-207396 | 7/2004 |
| JP | B2-3620404 | 11/2004 |
| JP | A-2006-080107 | 3/2006 |
| JP | A-2006-156694 | 6/2006 |
| JP | A-2006-253320 | 9/2006 |
| JP | A-2007-059807 | 3/2007 |
| JP | A-2007-173573 | 7/2007 |
| JP | A-2008-71858 | 3/2008 |
| JP | A-2008-078194 | 4/2008 |
| JP | A-2008-262984 | 10/2008 |

OTHER PUBLICATIONS

Office Action issued in Japanese Patent Application No. 2009-157852 dated Apr. 27, 2011 (with Translation).

Oct. 24, 2011 Office Action issued in Chinese Patent Application No. 201010222537.4 (with translation).

COIL COMPONENT

CROSS REFERENCE TO RELATED APPLICATION

This application claims priorities from Japanese Patent Application Nos. 2009-157852 filed Jul. 2, 2009 and 2009-187108 filed Aug. 12, 2009. The entire content of the priority applications are incorporated herein by reference.

TECHNICAL FIELD

The present invention relates to a coil component, and more particularly, to the coil component including an internal first core and an external second core adhesively fixed to and disposed around the internal first core.

BACKGROUND

Laid open Japanese Patent Application Publication Nos. 2001-338818 and 2004-207396 disclose a coil component including an internal drum core (first core) and an external core (second core) adhesively fixed to the drum core. Epoxy resin is used as the adhesive agent. These cores are formed of porous material generally produced by sintering, so that minute pores are formed into which the epoxy resin is impregnated to provide anchoring effect.

Due to the impregnation of the epoxy resin, shortage of amount of the adhesive agent may occur. Further, due to difference of osmotic pressure between the epoxy resin and curing agent contained in the adhesive agent, the curing agent is impregnated first prior to the impregnation of the epoxy resin. In this case, sufficient curing of the adhesive agent is not obtainable. Densification of the surface of the core can restrain impregnation of the adhesive agent into the core. However, anchor effect will be degraded.

If the core is made from a ferrite, wettability of the ferrite against the adhesive agent is insufficient. Therefore, an increased surface area is required for adhesive contact between the drum core and the external core. However, a low profile coil component having a compact configuration is required, which decreases the surface area for adhesion, thereby lowering adhesive strength between the drum core and the external core.

SUMMARY

In view of the foregoing, it is an object of the present invention to provide a coil component capable of ensuring sufficient adhesion or bonding strength between the first core and the second core.

This, and other objects of the present invention will be attained by providing a coil component including a first core, a second core, an inductive component and a pair of terminal electrodes. The first core has a first adhesion surface. The second core is connected to the first core by an adhesive agent and has a second adhesion surface in confrontation with the first adhesion surface. At least one of the first adhesion surface and the second adhesion surface is formed of a glass surface layer to which the adhesive agent is applied. The inductive component is wound over the first core, and has one end portion and another end portion. The pair of terminal electrodes are provided at one of the first core and the second core. The one end portion of the inductive component is electrically connected to one of the terminal electrodes and the other end portion is electrically connected to remaining one of the terminal electrodes.

DETAILED DESCRIPTION

Figure 1:
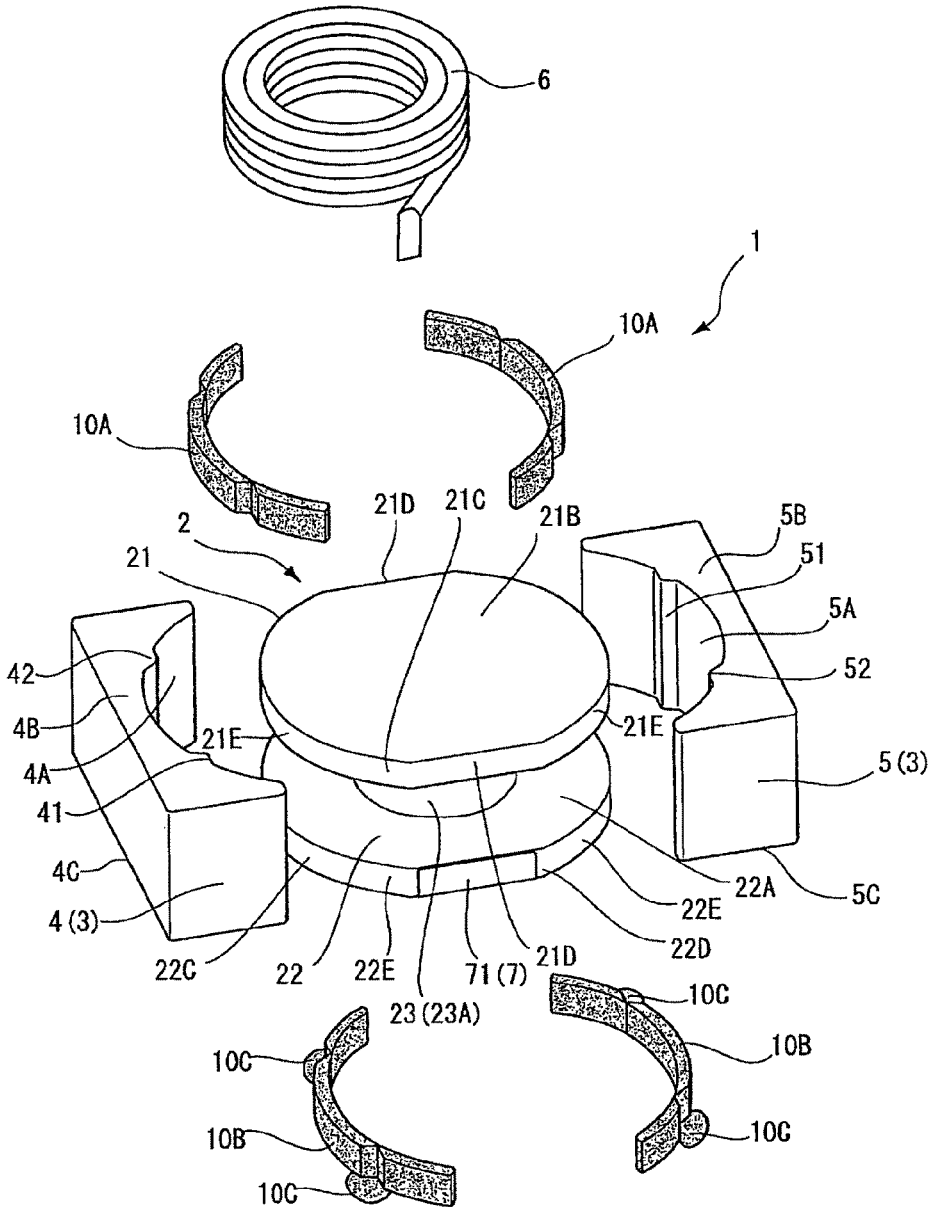
FIG. 1 is an exploded perspective view of a coil component according to one embodiment of the present invention.

A coil component according to one embodiment of the present invention will be described with reference to FIGS. 1 through 10. The coil component 1 generally includes a drum core (first core) 2, an external core (second core) 3, an inductive component or a wire 6, and terminal electrodes 7. The coil component 1 is downsized having a length ranging from 2.0 to 5.0 mm.

Figure 4:
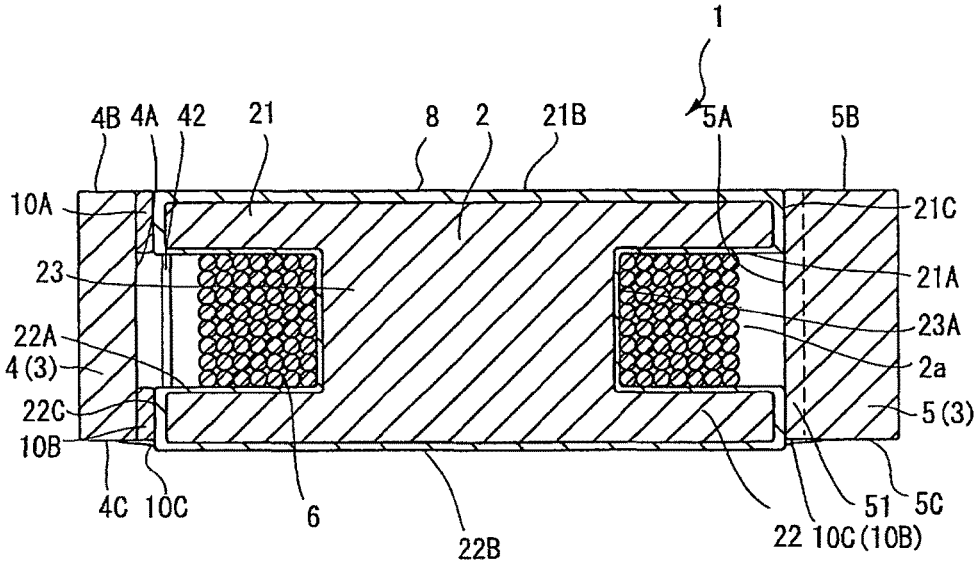
FIG. 4 is a cross-sectional view taken along the line IV-IV in FIG. 1.
Figure 5:
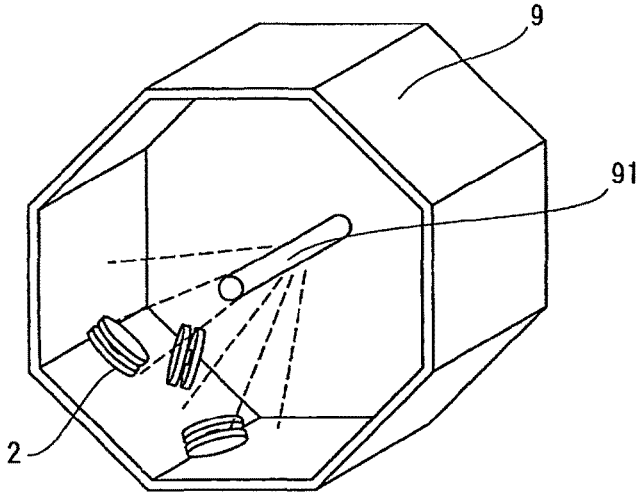
FIG. 5 is a schematic view for description of formation of a glass coating over a drum core which is one of elements of the coil component according to the embodiment.

The drum core 2 is formed of a magnetic base material containing manganese, for example, Mn—Zn system base material provided with electrical conductive property. As shown in FIGS. 1 and 4, the drum core 2 includes a generally cylindrical center section 23, a first flange section 21 provided coaxially with and at one axial end of the center section 23, and a second flange section 22 provided coaxially with and at another axial end of the center section 23. A contour of the first flange section 22 is identical with that of the second flange section, and a projected pattern of the first flange section 21 in an axial direction of the center section 23 is coincident with that of the second flange section 22.

As shown in FIG. 4, in the first flange section 21, there are provided a first inner surface 21A connected with the one end of the center section 23 and confronting the second flange section 23, a first outer surface 21B at one distal end of the drum core 2 and having a planner surface, and a first peripheral surface 21C positioned between the first inner surface 21A and the first outer surface 21B and crossing the first outer surface 21B. As shown in FIG. 1, the first peripheral surface 21C includes a pair of first linear portions 21D, 21D extending parallel to each other, and a pair of first arcuate portions 21E, 21E, each arcuate portion 21E connecting each end of each first linear portion to each other. A maximum distance between the pair of first arcuate portions 21E and 21E is greater than a distance between the pair of first linear portions 21D and 21D. (The pair of arcuate portions 21E, 21E are major sides, and the pair of first liner portions 21D, 21D are minor sides.) Incidentally, the first outer surface 21B functions as a suction surface (upper surface) to which a suction port of a suction device is abutted for surface-mounting the coil component 1. Further, the pair of first arcuate portions 21E, 21E functions as first confronting surfaces to be confronting with the external core 3 or as first adhesion surfaces to be adhesively connected to the external core 3.

In the second flange section 22, there are provided a second inner surface 22A connected with the other end of the center section 23 and confronting the first flange section 21, a second outer surface 22B at another distal end of the drum core 2 and having a planner surface, and a second peripheral surface 22C positioned between the second inner surface 22A and the second outer surface 22B and crossing the second outer surface 22B. The second outer surface 22B extends in a direction approximately parallel to the first outer surface 21B. The second peripheral surface 22C includes a pair of second linear portions 22D, 22D extending parallel to each other, and a pair of second arcuate portions 22E, 22E, each arcuate portion 22E connecting each end of each second linear portion to each other.

A maximum distance between the pair of second arcuate portions 22E and 22E is greater than a distance between the pair of second linear portions 22D and 22D. (The pair of arcuate portions 22E, 22E are major sides, and the pair of second liner portions 22D, 22D are minor sides.) In this connection, a direction from one of the second arcuate portion 22E to the remaining one of the second arcuate portion 22E will be referred to as a "primary direction", and a direction from one of the second linear portion 22D to the remaining one of the second linear portion 22D will be referred to as a "secondary direction". Incidentally, the second outer surface 22B functions as a surface-mount surface (lower surface) to be mounted on a circuit board (not shown). Further, the pair of second arcuate portions 22E, 22E functions as the first confronting surfaces to be confronting with the external core 3 or as the first adhesion surfaces to be adhesively connected to the external core 3.

The center section 23 has an outer peripheral surface 23A between the first and second inner surfaces 21A and 22A. A space 2*a* is defined by the outer peripheral surface 23A, and the first and second inner surfaces 21A, 22A. The inductive component 6 is wound over the center section 23 and is accommodated in the space 2*a* as shown in FIG. 4.

The drum core 2 is made from electrically conductive material, and its outer surface is entirely formed with an electrically insulating layer 8 such as a glass layer as shown in FIG. 4. Thus, the drum core 2 is electrically insulated. For forming the glass layer 8 over the drum core 2, a plurality of the drum cores 2 are accommodated in a barrel 9. A spray nozzle 91 extends into the barrel 9 at a rotational center thereof for spraying glass slurry in which fine glass powders and binders are suspended. The barrel 9 is rotatable about an axis of the spray nozzle 91.

A glass slurry layer is formed over each drum core 2 upon spraying the glass slurry out of the spray nozzle 91 during rotation of the barrel 9. Then, the glass slurry layer is subjected to drying by introducing dry air heated at a temperature about 70 C into the barrel 9. Accordingly, a fine glass powder layer is formed over each drum core 2. Then, the drum cores 2 are subjected to baking to volatilize and burn unwanted binder and to melt or soften the glass powders. Thus, a glass layer 8 having a flat outer surface can be formed over each drum core 2.

In the drum core 2, the outer peripheral surface 23A and the first and second inner surfaces 21A and 22A define a recess in cross-section to form the space 2*a*. Further, the above-described glass coating is performed by a simple spraying which is different from an electrostatic coating where each drum core elecrtostatically absorbs sprayed glass slurry. Therefore, in the simple spraying, deposition of the glass slurry onto the space 2*a* is lesser than the deposition onto the first outer surface 21B and first peripheral surface 21C of the first flange section 21 and the second outer surface 22B and second peripheral surface 22C of the second flange section 22. Accordingly, as shown in FIG. 4, a thickness of the glass layer 8 at the space 2*a* (defined by the outer peripheral surface 23A, and the first and second inner surfaces 21A, 22A) is smaller than that of the first and second outer surfaces 21B, 22B. More specifically, an average thickness of the glass layer 8 at the first and second outer surfaces 21B, 22B is about 10 μm, whereas an average thickness of the glass layer at the first and second inner surfaces 21A, 22A is about 5 μm, and the average thickness at the outer peripheral surface 23A is about 3 μm. The thickness is gradually reduced from the outer surface 21B (22B) toward the outer peripheral surface 23A.

As described above, the conductive component 6 is occupied in the space 2*a*. In this case, since the thickness of the glass layer 8 at the outer peripheral surface 23A is small, a volume of the space 2*a* can be increased, thereby increasing turning numbers of the inductive component or realizing employment of inductive component having a greater diameter. Consequently, property of the coil component can be improved.

Figure 2:
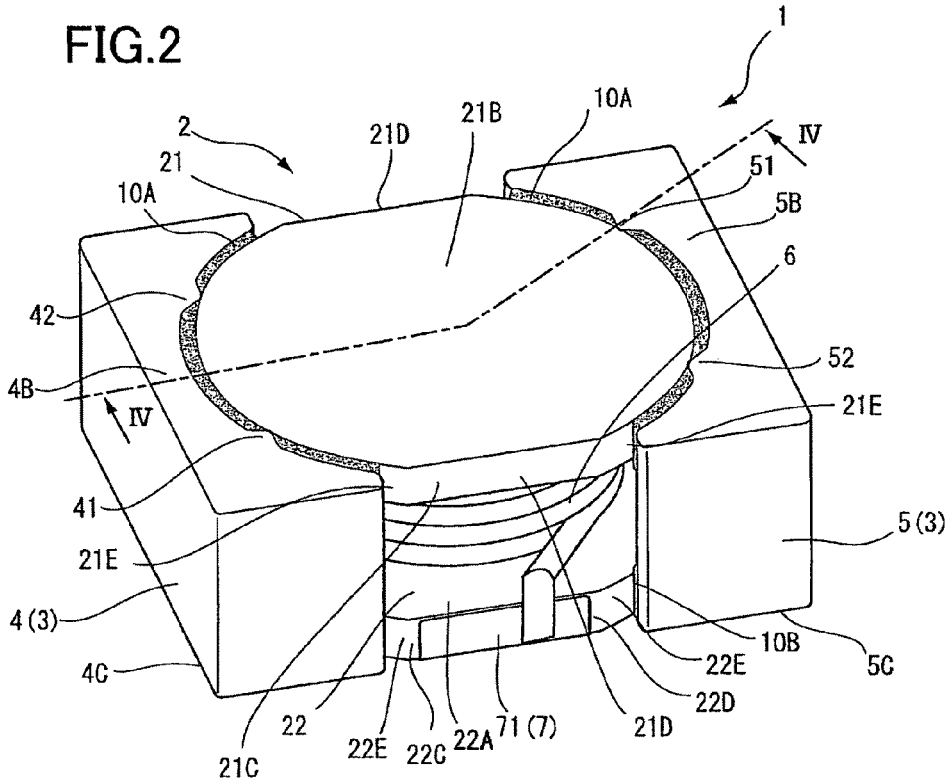
FIG. 2 is a perspective view of the coil component as viewed from a position thereabove.

The inductive component 6 includes a conductive wire provided with an insulation coating such as polyamide-imide resin. As shown in FIGS. 2 and 4, the inductive component 6 is wound over the outer peripheral surface 23A and accommodated in the space 2*a*. Since the inductive component 6 has the insulation coating, electrical short-circuit between the inductive component 6 and the drum core 2 does not occur even if the glass layer 8 at the space 2*a* is thin.

As shown in FIG. 1, the external core 3 includes a first divided core 4 and a second divided core 5 having a shape identical to that of the first divided core 4. Therefore, the following description pertains to the first divided core 4.

The first divided core 4 is formed of a magnetic material containing nickel, for example, Ni—Zn system ferrite is a base material provided with electrically insulating property. As shown in FIG. 4, the core 4 has a first internal surface 4A confronting the first and second peripheral surfaces 21C, 22C, a first end face 4B crossing the first internal surface 4A and positioned adjacent to the first outer surface 21B in an assembled state of the first divided core 4 to the drum core 2, and a second end face 4C crossing the first internal surface 4A and positioned adjacent to the second outer surface 22B in the assembled state of the first divided core 4 to the drum core 2. The first internal surface 4A has an arcuate shape in conformance with the arcuate shape of the first and second arcuate portions 21E, 22E, and has an arcuate length substantially the same as that of the first and second arcuate portions 21E, 22E. The first internal surface 4A functions as a second confronting surface or a second core adhesion surface to be adhered to the first and second arcuate portions 21E, 22E.

As shown in FIG. 4, the first and second end faces 4B, 4C are flat and smooth, and extend in a direction parallel to each other. In the first divided core 4, a distance between the first and second end faces 4B and 4C, i.e., a thickness of the first divided core 4, is slightly smaller than a distance between a surface of the glass layer 8 on the first outer surface 21B and a surface of the glass layer 8 on the second outer surface 22B, i.e., a thickness of the drum core 2 in its axial direction.

As shown in FIG. 1, the first internal surface 4A of the first divided core 4 has first and second protrusions 41 and 42 spaced away from each other in the arcuate direction, protruding radially inwardly (protruding toward the first and second peripheral surfaces 21C, 22C) and extending in an axial direction of the drum core 2 in an assembled state of the first divided core 4 to the drum core 2. Each axial end of the protrusions 41, 42 is flush with each end face 43, 4C.

A filling space (a space in which an adhesive agent, described later, is filled) is defined by the first and second protrusions 41, 42, the first and second peripheral surfaces 21C, 22C and the first internal surface 4A when the first and second protrusions 41, 42 are in abutment with the first and second peripheral surfaces 21C, 22C. Here, high dimensional accuracy of the filling space can be obtained, since the first and second protrusions 41, 42 can be formed at high dimensional accuracy. Accordingly a stabilized a magnetic gap can be provided between the drum core 2 and the external core 3, thereby stabilizing superimposed direct current characteristics.

Each protruding end portion of the first and second protrusions 41, 42 are formed into roundish shape, and a ridge line of each protrusion 41, 42 is in contact with the first and second arcuate portions 21E, 22E. Therefore, extremely narrow gap is provided between the ridge line (inflection point) and the first and second arcuate portions 21E, 22E in an imaginary plane perpendicular to the axial direction. Incidentally, dropped regions are defined on the second end face 4C at positions in alignment with the first and second protrusions 41, 42, such that UV curable resin is dropped onto each dropped region. The dropped regions are positioned to overlap with sloped surfaces of the protrusion, the sloped surfaces being located at opposite positions with respect to the ridge line of the protrusion 41, 42.

As shown in FIG. 1, the second divided core 5 has a shape identical with that of the first divided core 4, and has a second internal surface 5A, a first end face 5B, and a second end face 5C.

Figure 3:
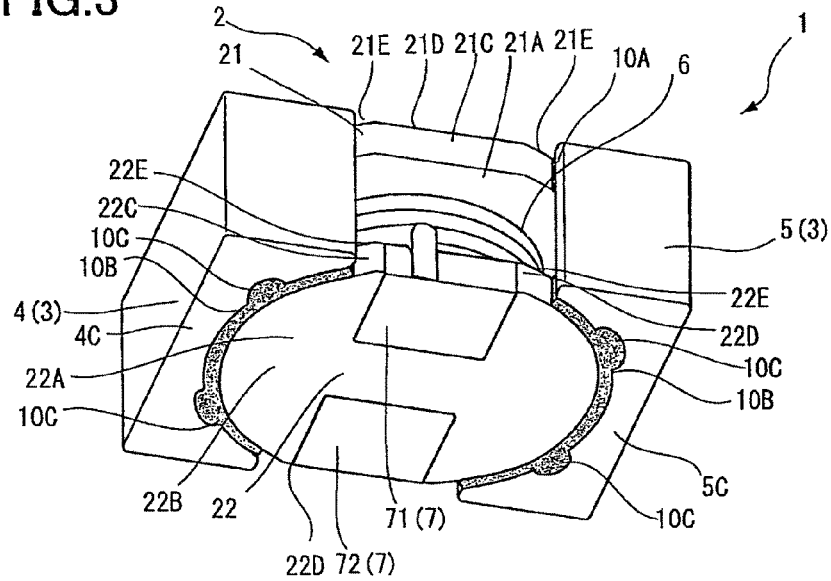
FIG. 3 is a perspective view of the coil component as viewed from a position therebelow.
Figure 6:
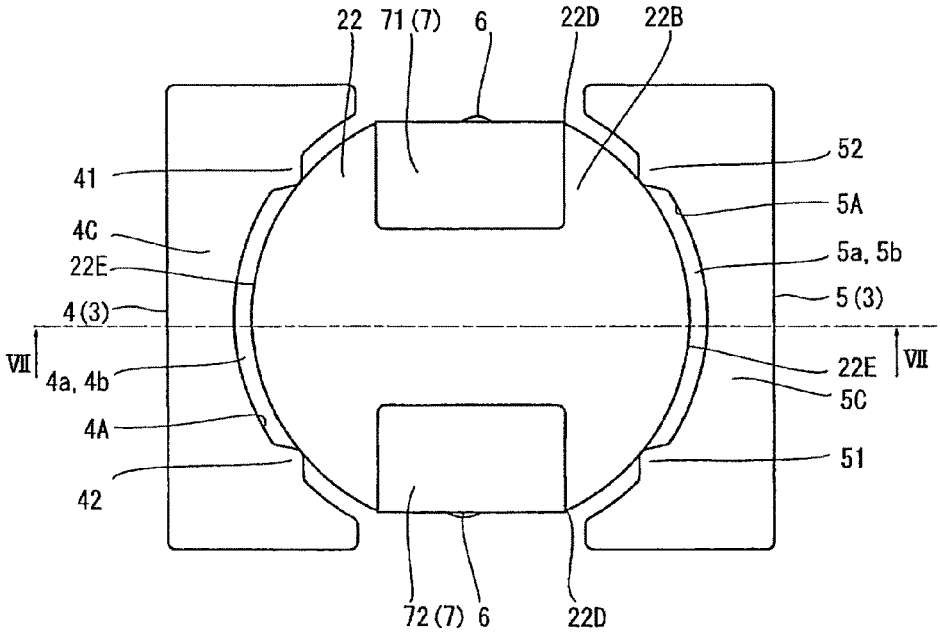
FIG. 6 is a top plan view of the coil component according to the embodiment.

As shown in FIG. 3, the terminal electrode 7 is formed at the second flange section 22. More specifically, a silver paste is coated on the glass layer 8 of the second flange section 22, and is baked. Then, nickel-tin plating is formed over the baked silver. As shown in FIGS. 3 and 6, the terminal electrode includes a first terminal electrode 71 to which one end portion of the inductive component 6 is connected by thermocompression bonding, and a second terminal electrode 72 to which another end portion of the inductive component 6 is connected by thermocompression bonding. The external core 4 can be assembled to the drum core 2 while the inductive component 6 is wound over the drum core 2 and is electrically connected to the terminal electrode 7, since the terminal electrode 7 is formed on the drum core 2. Consequently, production of the coil component can be facilitated.

The first terminal electrode 71 is formed in a straddling manner at the second outer surface 22B and one of the second linear portions 22D of the second peripheral surface 22C. The one end portion of the inductive component 6 is connected to the electrode part at one of the second linear portions 22D. The second terminal electrode 72 is formed in a straddling manner at the second outer surface 22B and remaining one of the second linear portions 22D of the second peripheral surface 22C. The other end portion of the inductive component 6 is connected to the electrode part at the remaining one of the second linear portions 22D.

In other words, the pair of terminal electrodes 71, 72 are provided at the second flange section 22 having the first axial end face 22B and a peripheral surface 22C crossing the first axial end face 22E. Each terminal electrode 71, 72 has a first part on the first axial end face 22B and a second part on the peripheral surface 22E. Each of the one end portion and the other end portion of the inductive component 6 is connected to each second part.

With this arrangement, a distance between a first surface mount region (first terminal electrode 71) and a second surface mount region (second terminal electrode 72) can be reduced when the coil component 1 is surface-mounted on a substrate (not shown), since the first and second terminal electrode 71 and 72 are arrayed on a line extending in the above-described secondary direction. Consequently, enhanced rigidity of the coil component 1 against any deformation or bending occurring at the substrate can be provided, thereby avoiding break-down of the coil component 1. Further, since each end portion of the inductive component 6 is not connected to the first part but is connected to the second part, the first part can be maintained flat to realize low profile coil component.

Further, electrical insulation between the terminal electrode 7 and the drum core 2 can be maintained, since the terminal electrode 7 is provided on the glass layer 8. Incidentally, instead of the above-described method for forming the terminal electrode 7, an electrode plate made from a copper can be adhered to the glass layer 8 on the second flange section 22.

For assembling the coil component 1, the drum core 2 formed with the glass coating layer 8 and the first and second divided cores 4 and 5 are set on a flat plane such as a surface of a table S such that the first outer surface 21B of the drum core 2 and the first end faces 4B, 5B of the external core 3 are flush with one another. In this state, in the drum core 2, the inductive component 6 has already been wound, and the terminal electrode 7 has already been formed, and each end portion of the inductive component 6 has been electrically connected to corresponding terminal electrode 7. The drum core 2 and the external core are bonded to each other by employing adhesive agents including UV curable resin 10B where ultraviolet curable resin is contained as a base material, and a thermosetting resin where thermo-setting epoxy resin is contained as a base material. Since the entire surface of the drum core 2 is formed with the glass coating layer 8, resultant drum core 2 can provide high mechanical strength.

Next, coil component production process will be described. First, base body preparation process is performed in which the glass layer 8 is formed over the drum core 2, the first and second terminal electrodes 71, 72 are formed over the glass layer 8, and the inductive component is wound over the drum core 2 and is electrically connected to the terminal electrodes 71, 72. Further, the external core 3 such as the first and second divided cores 4 and 5 are prepared.

Figure 7:
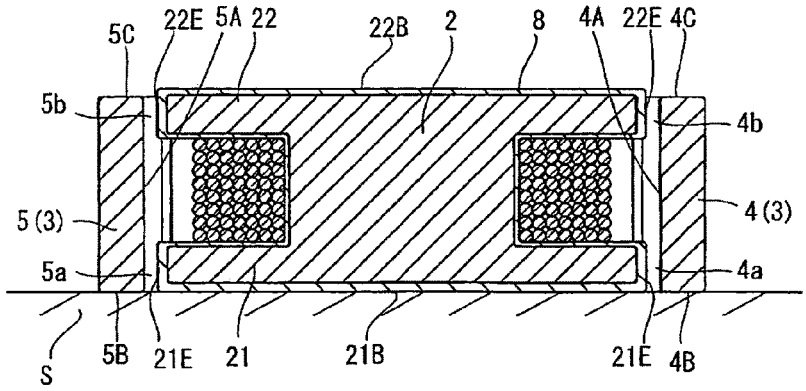
FIG. 7 is a cross-sectional view taken along the line VII-VII in FIG. 6.

Next, core positioning process is performed. That is, as shown in FIG. 6, the drum core 2 and the external core 3 are positioned such that the first internal surface 4A of the first divided core 4 confronts the one of the first arcuate portions 21E and the one of the second arcuate portions 22E, and the second internal surface 5A of the second divided core 5 confronts remaining one of the first arcuate portions 21E and remaining one of the second arcuate portions 22E. Further, each ridge line of the protrusions 41, 42, 51, 52 are in contact with the corresponding first and second arcuate portions 21E, 22E. With this positioning as shown in FIG. 7, adhesive agent filling spaces 4*a*, 4*b* are defined between the first internal surface 4A and the first and second arcuate portions 21E, 22E, and other adhesive agent filling spaces 5*a*, 5*b* are defined between the second internal surface 5A and the first and second arcuate portions 21E, 22E.

In the core positioning process, the first end faces 4B, 5B of the first and second divided cores 4 and 5, and the first outer surface 21B of the drum core 2 are in contact with an upper surface of the table S, so that these surfaces 4B, 5B and 21B are flush with one another. In this state, the second outer surface 22B of the drum core 2 is positioned higher than the second end faces 4C 5C of the external core 3 as shown in FIG. 7, since the thickness of the external core 3 is smaller than that of the drum core 2. Thus, stepped portions are defined between the second outer surface 22B and the second end faces 4C, 5C.

Figure 8:
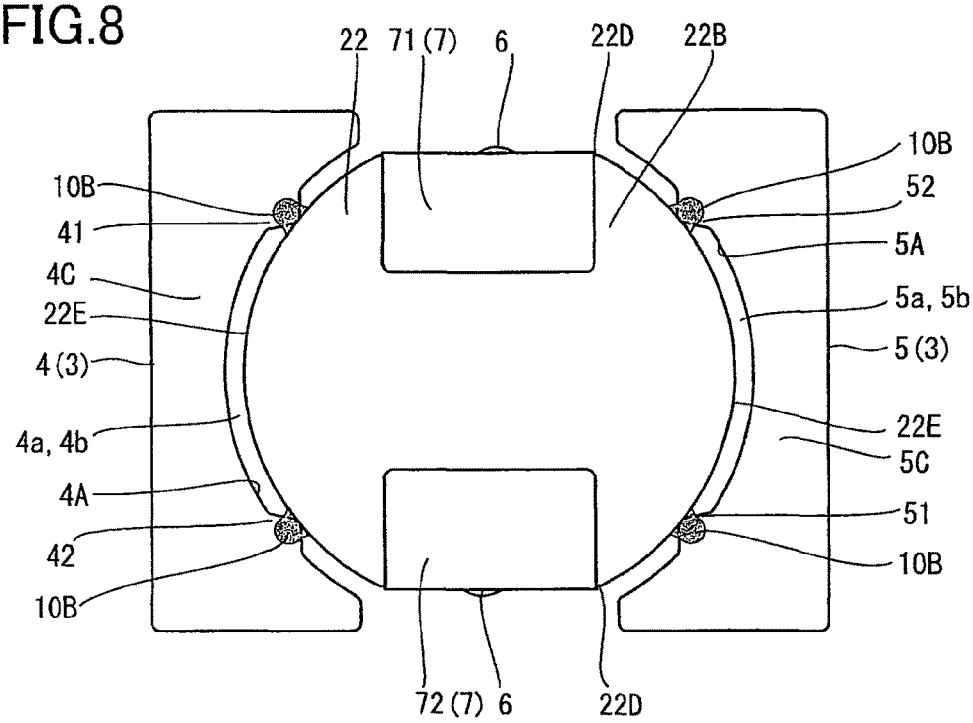
FIG. 8 is a top plan view showing a state where a liquidized UV curable resin is dropped onto a position between a second flange section of the drum core and an external core for the production of the coil component according to the embodiment.

Next, coating process as shown in FIG. 8 is performed in which UV curable resin 10B is dropped from a nozzle (not shown) onto the dropped region on the second end faces 4C, 5C. The UV curable resin 10B is of a liquid form and generally provides high fluidity having a viscosity ranging from 300 to 10000 mPas, and preferably from 1000 to 5000 mPas at the time of coating. As described above, since the dropped region includes end faces of the first and second protrusions 41, 42, and minute gaps are provided between the first protrusion 41 and the second arcuate portion 22E and between the second protrusion 42 and the second arcuate portion 22E, the liquidized UV curable resin 10 dropped onto the dropped region will be filled into the adhesive agent filling spaces 4*b*, 5*b* from the minute gaps because of capillary action. This is resin filling process.

The glass coating layer 8 has already been formed over the drum core 2 by way of glass melting, the surface of the glass coating layer 8 is not porous but is smooth and flat. Further, the glass coating layer 8 can provide high wettability with respect to the adhesive agent. Therefore, impregnation of the adhesive agent into the glass coating layer can be restrained. Even though sufficient adhesion force because of anchoring effect may not be attained, sufficient wettability of the glass coating layer 8 with respect to the adhesive agent can be attained to thus maintain adhesion force. Further, the glass coating layer 8 can provide a stabilized adhesion force regardless of surface condition of the drum core body (porous ferrite material).

In the filling process, a proper amount of adhesive agent (UV curable resin) can be filled into the filling spaces 4*b*, 5*b* because of the capillary action by simply dropping a proper amount of the adhesive agent onto the dropped region even if the coil component is downsized and the adhesion region is narrow. Consequently, stabilized bonding between the drum core 2 and the external core 3 can result, by filling the proper amount of adhesive agent into the filling spaces irrespective of a surface area for adhesion of the adhesive agent and regardless of dimension error between the drum core 2 and the external core 3.

Further, since the dropped region includes portions at both sloped surfaces of the first and second protrusions 41, 42 sloping downward from the top or ridge line of each protrusion, the adhesive agent can be properly filled into the filling space between the first and second protrusions 41 and 42 as well as remaining filling space at circumferentially end portion of the first and second divided cores 4, 5.

Further, the stepped portion is provided between the drum core 2 and the external core 3 because of the difference in height between the second end face 4C (5C) of the external core 3 and the second outer surface 22B of the drum core 2. Therefore, the second arcuate portions 22E prevent the dropped UV curable resin from flowing onto the second outer surface 22B. This prevention can avoid adhesion of the UV curable resin onto the terminal electrodes 7, thereby ensuring an electrical connection between the terminal electrodes 7 and a circuit board.

Next, ultraviolet radiation is performed to the UV curable resin 10B filled into the filling spaces 4*b*, 5*b* by an ultraviolet radiation device (not shown). Since the coil component 1 is downsized, the UV curable resin can be promptly cured upon irradiation to provide bonding between the drum core 2 and the external core 3. No external force has been applied to the drum core 2 and the external core 3 except for dropping the UV curable resin. Therefore, the drum core 2 and the external core 3 can be stationarily held on the table S. Consequently, no positional displacement occurs between these cores 2 and 3.

Since the UV curable resin 10B provides high fluidity, the resin can be sufficiently filled in spite of narrow filling space. Further, the cured UV resin 10 is not only interposed between the internal surface 4A (5A) and the second arcuate portion 22E, but also is bridging, in a form of a fillet 10C, between the drum core 2 and the external core 3 covering the end faces of the first and second protrusions 41, 42 at the stepped portion. The fillet 10C can increase an adhesion surface area between the drum core 2 and the external core 3 to thus increase adhesion strength.

Figure 10:
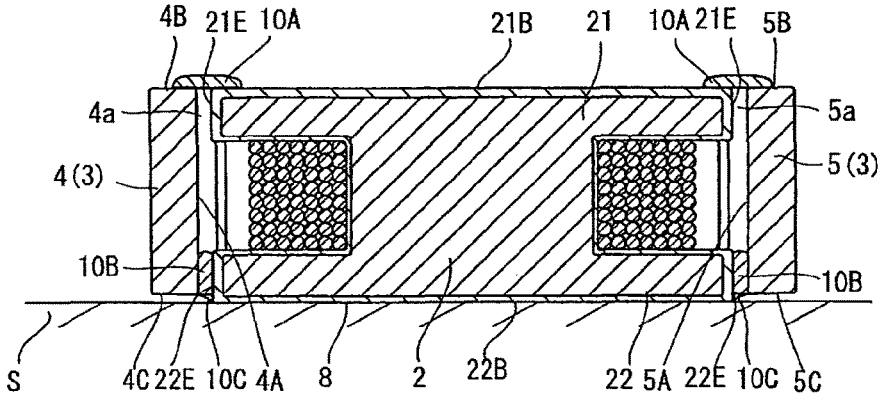
FIG. 10 is a cross-sectional view showing a state where a thermosetting resin has been filled in spaces between a first flange section of the drum core and the external core for the production of the coil component according to the embodiment.

Next as shown in FIG. 10, a thermosetting resin filling process is performed. That is, the drum core 2 and the external core 3 are turned upside down, so that the second outer surface 22B is mounted on the table S. In this state, a thermosetting resin 10A such as an epoxy resin is placed upon the filling space 4*a*, 5*a*, and thereafter, the thermosetting resin 10A is filled into the filling spaces 4*a*, 5*a* by using a paddle (not shown). Then, heating process is performed in which the drum core 2 and the external core 3 are moved into a heating oven to heat the thermosetting resin 10A for hardening the same. Since the drum core 2 and the external core 3 have already been adhesively bonded to each other by the UV curable resin 10B, displacement between the drum core 2 and the external core 3 does not occur during the filling and heating process. Because of the heating, the drum core 2 and the external core 3 can be firmly fixed to each other because of strong bonding force of the thermosetting resin 10A in combination with the bonding by the UV curable resin 10B.

Production of a coil component 1 is finished upon completion of adhesion between the drum core 2 and the external core 3. In this case, the second outer surface 22B on which the terminal electrodes 7 protrudes from the first end faces 4B, 5B, so that a surface contact of the second end face 22B with the circuit board can be ensured for stabilizing surface-mounting.

Further, each of the pair of second linear portions 22D at which a part of the each one of the electrodes 71, 72 is positioned is positioned between the first and second divided cores 4 and 5, and the linear portions 22D are positioned within an external contour connecting between the first and second divided cores 4 and 5 as shown in FIGS. 2, 3 and 6. Therefore, accidental electrical contact of the first and second electrodes 71, 72 with an ambient electronic component can be restrained to protect the electrically connected portion of the inductive component 6 to the electrodes.

Figure 9:
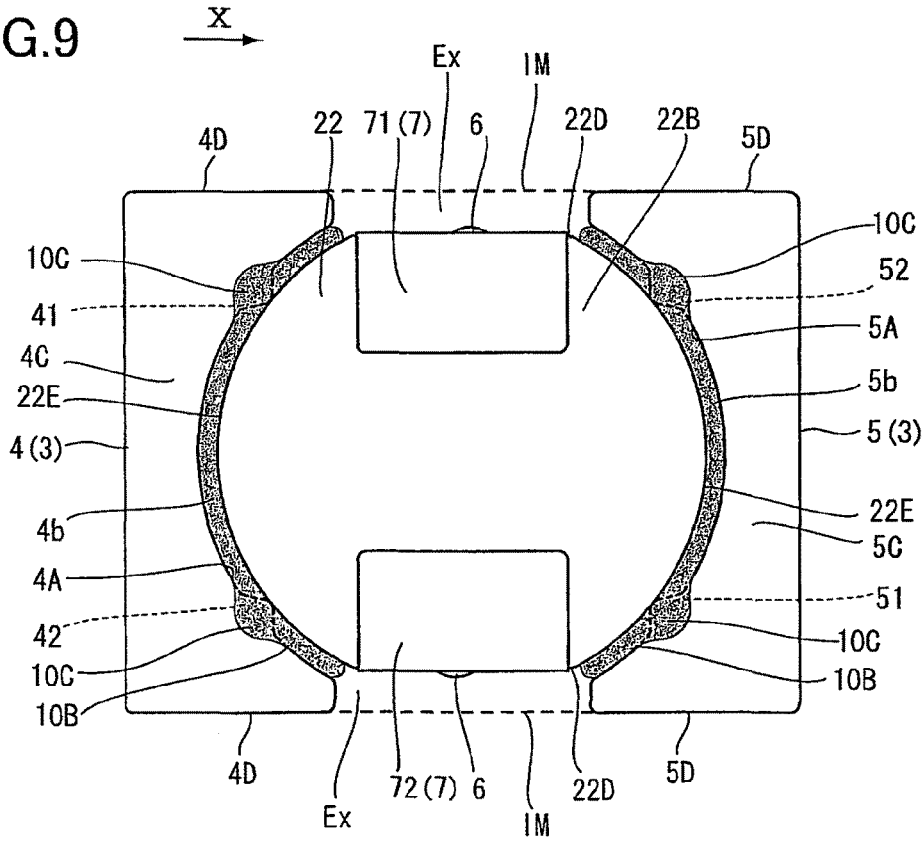
FIG. 9 is a top plan view showing a state where the liquidized UV curable resin has been filled in resin filling spaces for the production of the coil component according to the embodiment.

To be more specific, in FIG. 9, the first and second divided cores 4 and 5 are positioned spaced away from each other in a direction X so that the drum core 2 has exposed portions Ex which are not surrounded by the first and second divided cores. The above-described second part of each terminal electrode 71, 72 is positioned at each exposed portion Ex. Further, the first divided core 4 has a pair of first outline portions 4D, 4D extending toward the second divided core 5, and the second divided core 5 has a pair of second outline portions 5D, 5D extending toward the first divided core 4. An imaginary extension line IM is defined by connecting each first outline portion 4D to each second outline portion 5D. In this case, the second part of each terminal electrode is positioned closer to the drum core 2 than each imaginary extension line IM to the drum core 2.

Further, since the resin filling spaces 4*a*, 4*b*, 5*a*, 5*b* can provide high dimensional accuracy because of the formation of the protrusions 41, 42, variation in amount of adhesive agent to be filled into the filling spaces can be reduced, thereby reducing unevenness of adhesion and stabilizing adhesion.

Various modifications may be conceivable.

Figure 11:
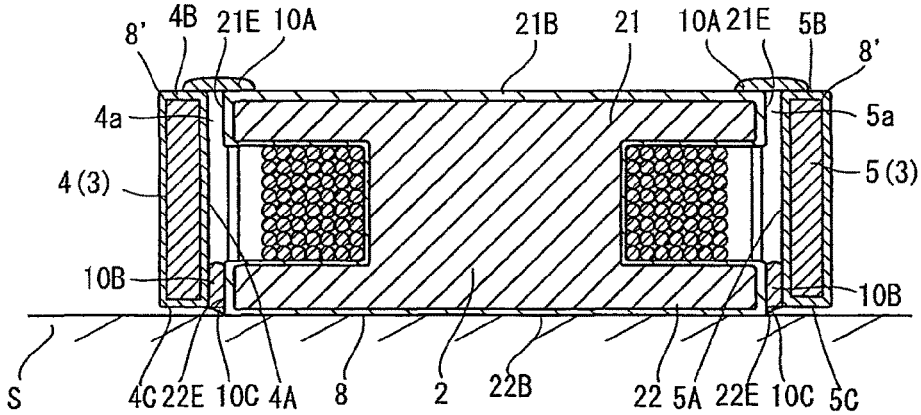
FIG. 11 is a cross-sectional view of a coil component according to a first modification.

Modification 1: In the above-described embodiment, the external core 3 is made from Ni—Zn ferrite base material. However, the external core 3 can be made from the material the same as that of the drum core 2, i.e., Mn—Zn ferrite base material. In the latter case, as shown in FIG. 11, a glass coating layer 8' should also be formed over the external core 3 in a manner similar to the method shown in FIG. 5. Accordingly, the adhesive agent is applied between the glass layer 8' of the external core 3 and the glass layer 8 of the drum core 2. Thus, adhesive force between the drum core 2 and the external core 3 can further be increased. Further, because of the formation of the glass layers 8, 8' (electrically insulating material), short circuit does not occur between the drum core 2 and the external core 3. Further, a ceramic core made from alumina is also available.

Figure 12:
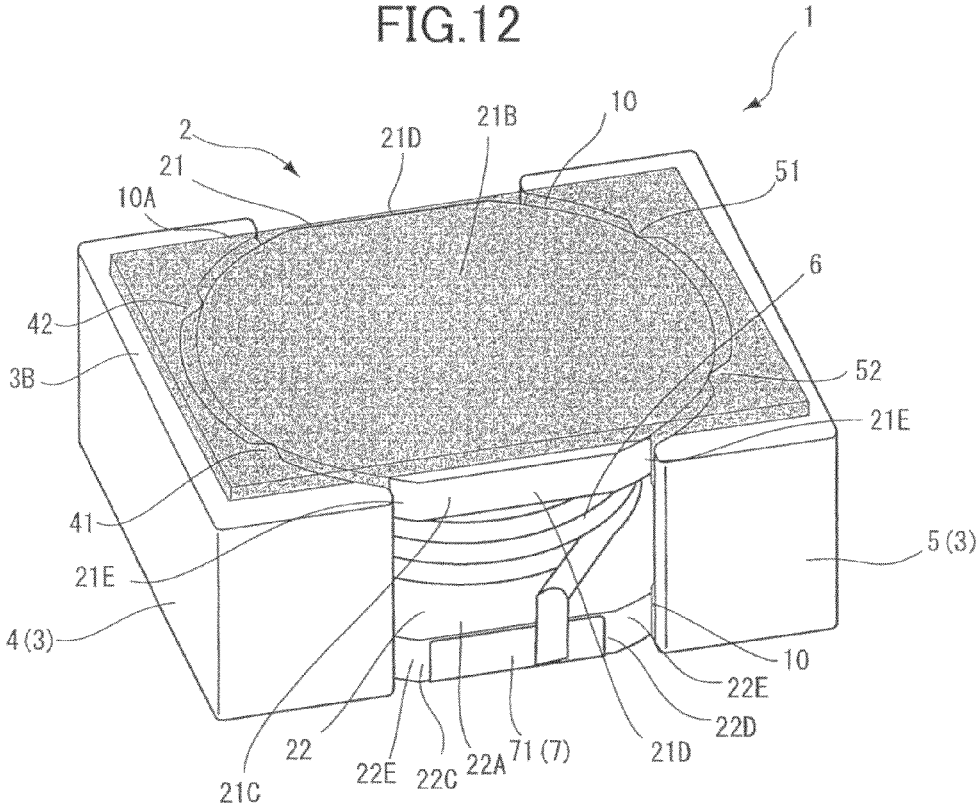
FIG. 12 is a perspective view of a coil component according to a second modification.

Modification 2: In the first flange section 21 of the coil component 1 according to above-described embodiment, the thermosetting resin 10A is applied only to the first peripheral surface 21C. However, the thermosetting resin 10A can also be formed over the first outer surface 21B of the first flange section and an upper surface 3B of the external core 3 as shown in FIG. 12. (Here, the first outer surface 21B is flush with the upper surface 3B). With this structure, adhesion surface area can be increased to further increase adhesion strength.

Figure 13:
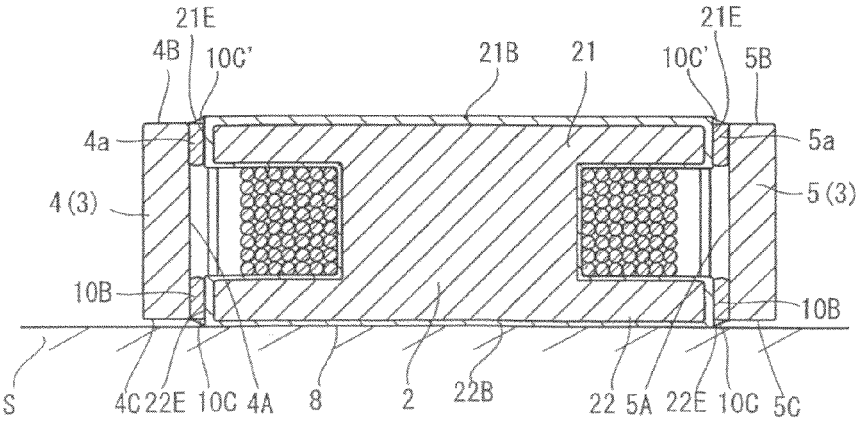
FIG. 13 is a cross-sectional view of a coil component according to a third modification.

Modification 3: In the above-described embodiment, the stepped portion between the drum core and the external core is provided at one axial end portion. However, the stepped portion can be provided at each axial end portion as shown in FIG. 13, so that the resin fillet 10C and 10C' can be formed at the axial end portions. In the latter case, adhesion surface area can be further increased to strengthen bonding between the drum core 2 and the external core 3. Alternatively, the axial thickness of the external core 3 can be equal to that of the drum core 2. In the latter case, no stepped portion is provided.

Modification 4: In the above-described embodiment, the UV curable resin and thermosetting resin are used. However, the UV curable resin can be dispensed with.

Modification 5: In the above-described embodiment, the glass coating layer is formed over an entire surface of the drum core 2, and in the above described modification 1, the glass coating layer is also formed over an entire surface of the external core 3. However, the glass coating can only be formed at a portion(s) where the adhesive agent is applied.

Modification 6: In the above-described embodiment, the external core 3 includes a pair of divided cores 4 and 5. However, an annular external core is also available.

Modification 7: In the above-described embodiment, the protrusions 41, 42 are formed at the external core 3. However, the protrusions can be exclusively formed at the drum core or can be formed at both the drum core and the external core. Alternatively, the protrusions can be dispensed with. In the latter case, a gap between the drum core and the external core can be controlled by controlling a thickness of the glass coating.

Modification 8: In the above-described embodiment, the terminal electrodes are provided at the drum core. However, the electrodes can be provided at the external core. In the latter case, each terminal electrode has a first part located on each end face 4C, 5C and a second part located on each internal surface 4A, 5A, and each end portion of the inductive component 6 is connected to each second part.

Modification 9: In the above described embodiment, the thermosetting resin 10A is pushingly filled into the filling spaces 4*a*, 5*a* by the paddle. However, a thermosetting resin 10A having a viscosity the same as that of the UV curable resin 10B can be used, so that the highly fluidized thermosetting resin can be filled into the spaces 4*a*, 5*a* by capillary action. Further, the UV curable resin 10B provides the above-described viscosity at a room temperature. However, the disclosed viscosity can be exhibited at the UV resin filling process.

While the invention has been described in detail with reference to the embodiments thereof, it would be apparent to those skilled in the art that various changes and modifications may be made therein without departing from the spirit of the invention.

What is claimed is:

1. A coil component comprising:

a first core having a first adhesion surface;

a second core connected to the first core by an adhesive agent and having a second adhesion surface in confrontation with the first adhesion surface, at least the first adhesion surface being formed of a glass surface layer to which the adhesive agent is applied;

an inductive component wound over the first core, and having one end portion and another end portion; and a pair of terminal electrodes provided at one of the first core and the second core, the one end portion being electrically connected to one of the terminal electrodes and the another end portion being electrically connected to remaining one of the terminal electrodes, wherein the first core is a drum core comprising a center section around which the inductive component is wound, the center section having one axial end and another axial end, a first flange section in a plate shape and provided at the one axial end, and a second flange section in a plate shape and provided at the another axial end, the first flange section and the second flange section providing a first confronting surface;

wherein the second core is an external core having a second confronting surface in confrontation with the first confronting surface;

wherein the first flange section has a first inner surface confronting the second flange section and connected with the one axial end, a first outer surface as a first axial end face of the drum core, and a first peripheral surface positioned between the first inner surface and the first outer surface;

wherein the second flange section has a second inner surface confronting the first flange section and connected with the another axial end, a second outer surface as a second axial end face of the drum core, and a second peripheral surface positioned between the second inner surface and the second outer surface;

wherein the center section has an outer peripheral surface positioned between the first inner surface and the second inner surface; and wherein the drum core has an entire outer surface formed with a glass layer to constitute the glass surface layer, the glass layer formed at the first inner surface, the second inner surface, and the outer peripheral surface having a thickness smaller than that of the glass layer formed at the first outer surface, the first peripheral surface, the second outer surface, and the second peripheral surface.

2. The coil component as claimed in claim 1, wherein the glass surface layer comprises a first glass surface layer constituting the first adhesion surface, and a second glass surface layer constituting the second adhesion surface.

3. The coil component as claimed in claim 1, wherein at least one of the first confronting surface and the second confronting surface is provided with a protrusion protruding toward and in contact with remaining one of the first confronting surface and the second confronting surface.

4. The coil component as claimed in claim 1, wherein the first adhesion surface is at the first confronting surface, and the second adhesion surface is at the second confronting surface.

5. The coil component as claimed in claim 1, wherein one of the first flange section and the second flange section has a first axial end face crossing the first adhesion surface;

wherein the second core has a second axial end face crossing the second adhesion surface and positioned in the vicinity of the first axial end face;

wherein the protrusion extends in an axial direction of the first core and has one axial end flush with one of the first axial end face and the second axial end face;

wherein the first axial end face and the second axial end face are discontinuous from each other to provide a stepped portion at a boundary therebetween; and wherein the adhesive agent is further applied to the one axial end of the protrusion and to the stepped portion such that the adhesive agent bridges between the first core and the second core.

6. The coil component as claimed in claim 5, wherein the one of the first axial end face and the second axial end face is protruding over a remaining one of the first axial end face and the second axial end face to provide the stepped portion, the pair of terminal electrodes being provided at the protruding one of the first axial end face and the second axial end face.

7. The coil component as claimed in claim 5, wherein one of the first flange section and the second flange section has a third axial end face crossing the first adhesion surface;

wherein the second core has a fourth axial end face crossing the second adhesion surface and positioned in the vicinity of the third axial end face;

wherein the protrusion extends in an axial direction of the first core and has another axial end flush with one of the third axial end face and the fourth axial end face;

wherein the third axial end face and the fourth axial end face are discontinuous from each other to provide a second stepped portion at a boundary therebetween; and wherein the adhesive agent is further applied to the another axial end of the protrusion and to the second stepped portion such that the adhesive agent bridges between the first core and the second core.

8. The coil component as claimed in claim 5, wherein the first axial end face is protruding over the second axial end face, the pair of terminal electrodes being provided at the first axial end face.

9. The coil component as claimed in claim 8, wherein the first axial end face has a shape defining a pair of major sides and a pair of minor sides, each of the pair of terminal electrodes being provided at each of the pair of minor sides.

10. The coil component as claimed in claim 8, wherein the pair of terminal electrodes are provided at the second flange section having the first axial end face and a peripheral surface crossing the first axial end face, each terminal electrode having a first part on the first axial end face and a second part on the peripheral surface, each of the one end portion and the another end portion of the inductive component being connected to the each second part.

11. The coil component as claimed in claim 10, wherein the external core comprises a first divided core, and a second divided core interposing the drum core therebetween, the first divided core and the second divided core being positioned spaced away from each other so that the drum core has exposed portions which are not surrounded by the first divided core and the second divided core, each second part of each terminal electrode being positioned at each exposed portion.

12. The coil component as claimed in claim 11, wherein the first divided core has a pair of first outline portions extending toward the second divided core, and the second divided core has a pair of second outline portions extending toward the first divided core, an imaginary extension line being defined by connecting each first outline portion to each second outline portion, each second part of each terminal electrode being positioned closer to the drum core than each imaginary extension line to the drum core.

13. The coil component as claimed in claim 1, wherein at least one of the first core and the second core is formed of Mn—Zn system ferrite base material.

* * * * *

UNITED STATES PATENT AND TRADEMARK OFFICE

CERTIFICATE OF CORRECTION

PATENT NO. : 8,164,409 B2
APPLICATION NO. : 12/801176
DATED : April 24, 2012
INVENTOR(S) : Takashi Kudo et al.

It is certified that error appears in the above-identified patent and that said Letters Patent is hereby corrected as shown below:

Title page, Item (75), Inventor: change "Shindoh (JP)" to --Tokyo (JP)--.

Signed and Sealed this
Third Day of July, 2012

David J. Kappos

David J. Kappos
*Director of the United States Patent and Trademark Office*